United States Patent [19]

Takayama et al.

[11] Patent Number: 4,513,301

[45] Date of Patent: Apr. 23, 1985

[54] HEAT-SENSITIVE RECORDING MATERIAL

[75] Inventors: Yukio Takayama, Hyogo; Akio Noguchi, Osaka; Takao Matsushita, Hyogo, all of Japan

[73] Assignee: Kanzaki Paper Manufacturing Company Limited, Tokyo, Japan

[21] Appl. No.: 558,817

[22] Filed: Dec. 7, 1983

[30] Foreign Application Priority Data

Dec. 11, 1982 [JP] Japan ..... 57-217587

[51] Int. Cl.[3] ..... B41M 5/18

[52] U.S. Cl. ..... 346/200; 346/226; 428/514; 428/522; 428/913

[58] Field of Search ..... 346/200, 226; 428/514, 428/522, 913, 914

[56] References Cited

U.S. PATENT DOCUMENTS 4,370,370 1/1983 Iwata et al. ..... 346/226

*Primary Examiner*—Bruce H. Hess

*Attorney, Agent, or Firm*—Murray, Whisenhunt and Ferguson

[57] ABSTRACT

In a heat-sensitive recording material in which a resin layer is formed on a recording layer containing at least a color forming material and a color developing material which forms a color when reacted with the color forming material by contact, a heat-sensitive recording material which is characterized in that the resin is essentially composed of an acetoacetylated polyvinyl alcohol and/or a copolymer of vinyl alcohol, acrylonitrile and optionally an other copolymerizable monomer.

6 Claims, No Drawings

HEAT-SENSITIVE RECORDING MATERIAL

The invention relates to heat-sensitive recording materials, and more particularly to heat-sensitive recording materials capable of retaining recorded images for a long period of time.

Heat-sensitive recording materials are well known which are adapted to form color images by thermally bringing a color forming material into contact with a color developing material which forms a color when reacted with the color forming material by contact. Since such heat-sensitive recording materials are relatively inexpensive and are recorded by a compact printing device with an easy maintenance, these materials are used for various purposes, e.g., as recording materials for a facsimile, calculator and the like. However, these recording materials are generally inferior in resistances to water, oils and plasticizers and have a disadvantage that the recorded images are markedly reduced in density when contacted with water, oils or plasticizers in a plastic film. Further, these recording materials are also low in resistance to organic solvents, and thus undesirable images are formed when an organic solvent contacts with a portion having no image.

To eliminate the above disadvantages proposed are a method of coating on a heat-sensitive recording layer an aqueous emulsion of a resin having a film-forming ability and resistance to chemical substances (Japanese Unexamined Patent Publication No. 128,347/1979), a method of coating on the layer a water-soluble high molecular compound such as a polyvinyl alcohol, etc. (Japanese Unexamined Utility Model Publication No. 125,354/1981). However, these methods accompany new defects together with the improvements and the desired effects are not sufficiently obtained. Namely, in case an aqueous resin coating is formed on a heat-sensitive recording layer, it is necessary to restrain the drying temperature to avoid undesirable images in the recording layer due to high temperatures. However, this brings an insufficient curing of the resin and adhesion of the resin layer to the recording head (hereinafter referred to as "sticking") occurs. Further, under extremely severe conditions in which resistances to both water and plasticizer are required or resistance to oil or plasticizer for a long period of time is required, the above conventional resin coated recording materials having a defect that the image density reduces.

An object of the invention is to provide a heat-sensitive recording material which is capable of retaining images for a long period of time even under severe conditions and free from the sticking and like new defects.

The above and other objects of the invention will be apparent from the following description.

In a heat-sensitive recording material in which a resin layer is formed on a recording layer containing at least a color forming material and a color developing material which forms a color when reacted with the color forming material by contact, the present heat-sensitive recording material is characterized in that the resin is essentially composed of an acetoacetylated polyvinyl alcohol and/or a copolymer of vinyl alcohol, acrylonitrile and optionally an other copolymerizable monomer.

In the invention, it is found that the acetoacetylated polyvinyl alcohol and the copolymer of vinyl alcohol, acrylonitrile and optionally an other copolymerizable monomer exhibit an excellent curing (hardening) ability compared with conventional polyvinyl alcohol and like water-soluble high molecular compounds even under a mild drying condition, and given an extremely excellent capability of retaining images for a long period of time.

According to the invention, the combination of a color forming material and a color developing material is not particularly limited, insofar as the two components undergo a color forming reaction upon contact with each other. Examples of useful combinations are the combination of a colorless or pale-colored electron donating organic chromogenic material (hereinafter referred to as "basic dye") and an inorganic or organic electron accepting reactant material (hereinafter referred to as "color acceptor"), and the combination of ferric stearate or like higher fatty acid metal salt and gallic acid or like phenol. Furthermore diazonium compounds, couplers and other basic substances are usable in combination. Thus the present invention covers heat-sensitive recording materials which comprise such a combination and which are adapted to form visible images (record images) when exposed to heat.

Among various combinations, however, the combination of a basic dye and a color acceptor is especially preferable because the specific resin layer of the invention, when used with this combination, extremely enhances capability of retaining images for a long period of time.

Various known basic dyes are used as color forming materials in this invention. Examples of useful dyes are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoylleucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-(diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl- 7-(p-toluidino)fluoran, 3-diethylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)-fluoran, 3-dibutylamino-7-(o-chlorophenylamino)fluoran, 3-pyrrolidino-6-methyl-7-p-butylphenylaminofluoran, etc.

As a color acceptor are used various known inorganic and organic acidic materials which form color in contact with the basic dyes. Examples of useful inorganic acidic materials are activated clay, acid clay, attapulgite, bentonite, colloidal silica and aluminum silicate. Examples of organic acidic materials include 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylenebis(4-methyl-6-tert-isobutylphenol), 4,4'-isopropylidenebis(2-tert-butylphenol), 4,4'-sec-butylidenediphenol, 4-phenylphenol, 4,4'-isopropylidenediphenol(bisphenol-A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resin, phenolic polymer and like phenolic compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicylic acid and like aromatic carboxylic acids; also, salts of such phenolic compounds or aromatic carboxylic acids with zinc, magnesium, aluminum, calcium, titanium, manganese, tin, nickel and like polyvalent metals, etc.

With the heat-sensitive recording materials of the invention, the proportions of color forming material the color developing material to be used for the recording layer are not particularly limited but can be determined suitably according to the kinds of color forming material and color developing material. For example when a basic dye and a color acceptor are used, usually 1 to 50 parts by weight, preferably 2 to 10 parts by weight, of the color acceptor is used per part by weight of the basic dye.

For preparing a coating composition comprising the foregoing components, the color forming material and the color developing material are dispersed, together or individually, into water serving as a dispersion medium, using stirring and pulverizing means such as a ball mill, attrition mill or sand mill. Usually the coating composition has incorporated therein a binder in an amount of 10 to 70% by weight, preferably 15 to 50% by weight, based on the total solids content of the composition. Examples of useful binders are starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic copolymer salt, styrene-butadiene copolymer emulsion, etc. Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as benzophenone and triazole compounds, defoaming agents, fluorescent dyes, coloring dyes, etc.

Further, to the composition may be added zinc stearate, calcium stearate, polyethylene wax, carnauba wax, paraffin wax, ester wax or like waxes; kaolin, clay, talc, calcium carbonate, calcined clay, titanium oxide, kieselguhr, finely divided anhydrous silica, activated clay or like inorganic pigment; and stearic acid amide, stearic acid methylenebisamide, oleic acid amide, palmitic acid amide, sperm oleic acid amide, coconut fatty acid amide or like sensitizer.

The method of forming the recording layer of the heat-sensitive recording material of the invention is not particularly limited, but conventional techniques are usable. For example, the coating composition is applied to a substrate by an air knife coater, blade coater or like suitable means. The amount of coating composition to be applied, which is not limited particularly, is usually 2 to 12 g/m$^2$, preferably 3 to 10 g/m$^2$, based on dry weight.

The present invention is characterized in that on the recording layer was formed a resin layer which is essentially composed of an acetoacetylated polyvinyl alcohol and/or a copolymer of vinyl alcohol, acrylonitrile and optionally an other copolymerizable monomer.

The degree of acetoacetylation of the polyvinyl alcohol is suitably varied depending on the quality of the desired heat-sensitive recording material and is generally 0.1 to 20 mole%, preferably 0.5 to 10 mole%.

Although the acetoacetylated polyvinyl alcohol can be prepared by any of known methods but is preferably prepared by adding liquid or gaseous diketene to a solution, dispersion or powder of polyvinyl alcohol. Any of acetoacetylated polyvinyl alcohols may be used provided that the acetoacetylation degree is in the above range.

Examples of useful polyvinyl alcohols are those obtained by saponifying polyvinyl acetate for example in a lower alcohol solution in the presence of a catalyst, saponification product of a copolymer of vinyl acetate and an other copolymerizable monomer etc. Examples of monomers which are copolymerizable with vinyl acetate include maleic acid, maleic anhydride, fumaric acid, crotonic acid, itaconic acid, (meth)acrylic acid and like unsaturated carboxylic acid and esters thereof; ethylene, propylene and like α-olefins; (meth)allylsulfonic acid, ethylenesulfonic acid, sulfonic acid maleate and like olefin sulfonic acids; sodium (meth)allylsulfonate, sodium ethylenesulfonate, sodium sulfonate (meth)acrylate, sodium sulfonate monoalkyl maleate, sodium disulfonate alkyl maleate and like olefin sulfonic acid alkali metal salts; acrylamide, N-methylolacrylamide, acrylamide alkylsulfonic acid alkali metal salt and like amido group containing monomers; N-vinylpyrrolidone and derivatives thereof, etc.

Any of copolymers of vinyl alcohol, acrylonitrile and optionally an other copolymerizable monomer may be used which are obtained by copolymerizing the components via their vinyl groups. The acrylonitrile units may be contained in either main chain or side chain and the content thereof in the copolymer is preferably 0.5 to 45 mole%, more preferably 1 to 20 mole%. As the above copolymerizable monomers, same compounds can be used as in the acetoacetylated polyvinyl alcohol.

Although the acetoacetylated polyvinyl alcohol and the copolymer of vinyl alcohol, acrylonitrile and optionally an other copolymerizable monomer (both are hereinafter referred to as "PVA resin") have excellent curing ability, a resin layer having more improved curing ability is obtained when a curing agent is further added, which is one of the preferred embodiments of the invention. Examples of useful curing agents are those react with hydrophilic groups in the resin to produce crosslinked and water-resistant film and are formalin, glyoxal, glycine, glycidyl ester, glycidyl ether, dimethylol-urea, ketene dimer, dialdehyde starch, melamine resin, polyamide, polyamide-epichlorohydrin resin, ketone-aldehyde resin, polyethyleneimine, boric acid, borax, ammonium chloride, magnesium chloride, calcium chloride, aluminum sulfate, magnesium sulfate, calcium hydroxide, zirconium ammonium carbonate, alkoxides of Ti, Zr, or Al, etc. These curing agents are used singly or at least two of them are used.

Although the amount of the curing agent varies with the quality of the desired recording materials, kinds of the resin and curing agent, pot life of resin coating composition, it is generally 0.001 to 100 parts by weight, preferably 0.1 to 30 parts by weight per 100 parts by weight of the resin component.

To improve the printability of the recording material and to prevent the sticking, a pigment can be added as required to the resin coating composition containing the PVA resin as a main component. The pigment is generally added in an amount of 5 to 500 parts by weight per 100 parts by weight of the resin component. Examples of useful pigments include calcium carbonate, zinc oxide, aluminum oxide, titanium dioxide, silicone dioxide, aluminum hydroxide, barium sulfate, zinc sulfate, talc, kaolin, clay, calcined clay, colloidal silica and like inorganic pigment, polystyrene microball, nylon powder, polyethylene powder, urea-formaldehyde resin filler, starch particle and like organic pigment, etc.

Various other auxiliary agents can be further added to the coating composition. Examples of useful agents are lubricants such as zinc stearate, calcium stearate, stearic acid amide, polyethylene wax, carnauba wax, paraffin wax, ester wax, etc, surfactants such as sodium dioctyl sulfosuccinate, etc (as dispersant or wetting agent), pH adjusting agents such as potash alum, etc, defoaming agents, etc.

The coating composition of the invention containing the PVA resin is generally prepared in the form of an aqueous coating composition using stirring and dispersing means as required such as a mixer, attrition mill, ball mill or roll mill and is coated on the heat-sensitive recording layer with use of a known coating apparatus. The curing agent can be mixed with the coating composition but may be coated separately. Particularly in an embodiment of forming a curing agent layer and resin layer separately, a highly effective curing agent can be used without regard to pot life of the resin coating composition.

The PVA resin and curing agent are separately applied to the recording layer by various method, for example, (a) by coating a resin coating composition on the recording layer containing a curing agent,
(b) by forming a curing agent layer between the recording layer and resin layer,
(c) by forming a curing agent layer on the resin layer, etc.

Among these, the method (c) is one of the preferred embodiments of the invention since the resin layer has an excellent curing ability and capability of retaining images for a long period of time.

The amount of resin coating composition to be applied is not limited particularly but the desired effect of the invention is not obtained sufficiently when the amount is less than 0.1 g/m$^2$ and the recording sensitivity tends to become extremely low when more than 20 g/m$^2$. Accordingly, it is usually 0.1 to 20 g/m$^2$, preferably 0.5 to 10 g/m$^2$, based on dry weight.

Thus, the heat-sensitive recording material having an excellent capability of retaining images for a long period of time without entailing the sticking or like disadvantages is obtained, by forming on the recording layer a resin layer comprising the PVA resin of the invention as a main component.

Further, it is possible to enhance the capability of retaining images as required by forming the resin layer on the reverse side of the heat-sensitive recording material.

The heat-sensitive recording material of the invention has an excellent capability of retaining images and thus is usable not only as a usual heat-sensitive recording material but also as a so-called release-type heat-sensitive recording material which has a pressure-sensitive adhesive layer on the reverse side of the recording material and a release paper covered thereon.

Any of patterns can be printed as required on the resin layer of the heat-sensitive recording material of the invention with use of a known ink such as UV curable ink, flexographic ink, etc.

The invention will be described below in more detail with reference to Examples and Comparison Examples by no means limited to, in which parts and percentages are all by weight, unless otherwise specified.

EXAMPLE 1

(1) Composition (A)

3-(N-cyclohexyl-N-methylamino)-6-methyl-7-phenylaminofluoran (10 parts), 5 parts of 5% aqueous solution of methyl cellulose and 30 parts of water were pulverized by a sand mill to prepare Composition (A) having an average particle size of 3 μm.

(2) Composition (B)

4,4'-Isopropylidenediphenol (20 parts), 5 parts of 5% aqueous solution of methyl cellulose and 55 parts of water were pulverized by a sand mill to obtain Composition (B) having an average particle size of 3 μm.

(3) Preparation of a recording layer

A 45-part quantity of Composition (A), 80 parts of Composition (B), 50 parts of 20% aqueous solution of oxidized starch and 10 parts of water were mixed with stirring to prepare a coating composition. The coating composition was applied to a paper substrate weighing 50 g/m$^2$ in an amount of 5 g/m$^2$ by dry weight to prepare a heat-sensitive recording paper.

A 800-part quantity of 12% aqueous solution of acetoacetylated polyvinyl alcohol (Gohsefimer Z-200, a product of the Nippon Synthetic Chemical Industry Co., Ltd). was mixed with 20 parts of 5% aqueous solution of dimethylolurea to obtain a resin coating composition. The coating composition was applied to the above recording layer of the heat-sensitive recording material in an amount of 6 g/m$^2$ by dry weight to obtain a resin-coated heat-sensitive recording paper.

EXAMPLE 2

A resin-coated heat-sensitive recording paper was prepared in the same manner as in Example 1 with the exception of using a resin coating composition obtained from 800 parts of 12% aqueous solution of the same acetoacetylated polyvinyl alcohol used in Example 1, 20 parts of 5% aqueous solution of dimethylolurea, 100 parts of calcium carbonate (Softon 1800, a product of Bihoku Funka Co., Ltd.) and 100 parts of water.

EXAMPLE 3

To the recording layer prepared in the same manner as in Example 1 was applied a resin coating composition obtained from 800 parts of 12% aqueous solution of the same acetoacetylated polyvinyl alcohol used in Example 1, 100 parts of calcium carbonate (Softon 1800) and 100 parts of water in an amount of 6 g/m$^2$ by dry weight. To the coated surface was applied 1% aqueous solution of dimethylolurea in an amount of 10 cc/m$^2$ to prepare a resin-coated heat-sensitive recording paper.

EXAMPLE 4

A resin-coated heat-sensitive recording paper was prepared in the same manner as in Example 2 except that 50 parts of 2% aqueous solution of boric acid was used in place of 5% aqueous solution of dimethylolurea in the resin coating composition.

EXAMPLE 5

A resin-coated heat-sensitive recording paper was prepared in the same manner as in Example 2 except that 5% aqueous solution of glyoxal and kaolin (UW-90, a product of Engelhard Minerals & Chemicals Corp.) were used in place of 5% aqueous solution of dimethylolurea and calcium carbonate in the resin coating composition.

EXAMPLE 6

A resin-coated heat-sensitive recording paper was prepared in the same manner as in Example 2 except that 4,4'-cyclohexylidenediphenol was used in place of 4,4'-isopropylidenediphenol in the preparation of Composition (B), and 100 parts of 10% aqueous solution of dialdehyde starch (Caldas C-5S, a product of The Japan Carlit Co., Ltd.) and kaolin (UW-90) were used in place of 5% aqueous solution of dimethylolurea and calcium carbonate in the preparation of resin coating composition.

EXAMPLE 7

A resin-coated heat-sensitive recording paper was prepared in the same manner as in Example 6 except that benzyl 4-hydroxybenzoate was used in place of 4,4'-cyclohexylidenediphenol in the preparation of Composition (B).

EXAMPLE 8

A resin-coated heat-sensitive recording paper was prepared in the same manner as in Example 1 with the exception of using a resin coating composition obtained from 1000 parts of 10% aqueous solution of acrylonitrile-acrylamide-vinyl alcohol copolymer, 150 parts of 2% aqueous solution of boric acid and 100 parts of calcium carbonate (Softon 1800).

EXAMPLES 9 AND 10

Two kinds of resin-coated heat-sensitive recording papers were prepared in the same manner as in Example 8 except that each of 200 parts of 5% aqueous solution of dimethylolurea (Example 9) and 150 parts of 20% aqueous solution of glyoxal (Example 10) was used in place of 2% aqueous solution of boric acid.

EXAMPLE 11

(1) Composition (A)

3-(N-cyclohexyl-N-methylamino)-6-methyl-7-phenylaminofluoran (10 parts), 5 parts of 5% aqueous solution of methyl cellulose and 30 parts of water were pulverized by a sand mill to prepare Composition (A) having an average particle size of 3 μm.

(2) Composition (B)

4,4'-Cyclohexylidenediphenol (20 parts), 5 parts of 5% aqueous solution of methyl cellulose and 55 parts of water were pulverized by a sand mill to obtain Composition (B) having an average particle size of 3 μm.

(3) Preparation of a recording layer

A 45-part quantity of Composition (A), 80 parts of Composition (B), 50 parts of 30% aqueous solution of ethylene-acrylic acid copolymer salt (Zaikthene A, a product of Seitetsu Kagaku Co., Ltd.) and 10 parts of water were mixed with stirring to prepare a coating composition. The coating composition was applied to a paper substrate weighing 50 g/m$^2$ in an amount of 5 g/m$^2$ by dry weight to prepare a heat-sensitive recording paper.

A 800-part quantity of 12% aqueous solution of acetoacetylated polyvinyl alcohol (Gohsefimer Z-200) was mixed with 20 parts of 5% aqueous solution of glyoxal, 50 parts of 2% aqueous solution of boric acid, 100 parts of kaolin (UW-90) and 100 parts of water to obtain a resin coating composition. The coating composition was applied to the above recording layer of the heat-sensitive recording material in an amount of 6 g/m$^2$ by dry weight to obtain a resin-coated heat-sensitive recording paper.

EXAMPLE 12

To the recording layer prepared in the same manner as in Example 11 was applied a resin coating composition obtained from 800 parts of 12% aqueous solution of acetoacetylated polyvinyl alcohol (Gohsefimer Z-200), 100 parts of kaolin(UW-90) and 100 parts of water in an amount of 6 g/m$^2$ by dry weight. To the coated surface was applied a curing solution comprising 20 parts of 5% aqueous solution of glyoxal, 50 parts of 2% aqueous solution of boric acid and 200 parts of water in an amount of 10 cc/m$^2$ to prepare a resin-coated heat-sensitive recording paper.

EXAMPLE 13

A resin-coated heat-sensitive recording paper was prepared in the same manner as in Example 11 with the exception of using a resin coating composition which was prepared by adding 2 parts of sodium dioctylsulfosuccinate (Nissan Rapizol B-80, a product of Nippon Oil & Fats Co., Ltd.) to the resin coating composition of Example 11.

EXAMPLE 14

A resin-coated heat-sensitive recording paper was prepared in the same manner as in Example 13 except that 50 parts of 5% aqueous solution of potash alum was further added to the resin coating composition.

COMPARISON EXAMPLE 1

A resin-coated heat-sensitive recording paper was prepared in the same manner as in Example 1 except that 800 parts of 12% aqueous solution of polyvinyl alcohol (PVA 110, a product of Kuraray Co., Ltd.) was used in place of acetoacetylated polyvinyl alcohol, and 400 parts of 5% aqueous solution of dimethylolurea was used in place of 20 parts thereof.

COMPARISON EXAMPLE 2

A resin-coated heat-sensitive recording paper was prepared in the same manner as in Example 2 except that 800 parts of 12% aqueous solution of polyvinyl alcohol (PVA 110) was used in place of acetoacetylated polyvinyl alcohol, and 400 parts of 5% aqueous solution of dimethylolurea was used in place of 20 parts thereof.

COMPARISON EXAMPLE 3

A resin-coated heat-sensitive recording paper was prepared in the same manner as in Comparison Example 2 except that polyvinyl alcohol (PVA 205, a product of Kuraray Co., Ltd.) was used in place of polyvinyl alcohol (PVA 110) and 250 parts of 20% aqueous solution of glyoxal was used in place of 5% aqueous solution of dimethylolurea.

COMPARISON EXAMPLE 4

A resin-coated heat-sensitive recording paper was prepared in the same manner as in Example 2 except that 240 parts of 40% aqueous solution of polyurea (Sumirez Resin 614, a product of Sumitomo Chemical Co., Ltd.) and 500 parts of 10% aqueous solution of dialdehyde starch (Caldas C-5S) were used in place of acetoacetylated polyvinyl alcohol and 5% aqueous solution of dimethylolurea.

COMPARISON EXAMPLE 5

A resin-coated heat-sensitive recording paper was prepared in the same manner as in Example 2 except that 275 parts of 35% aqueous solution of polyurethane (Aizelax HA-1, a product of Hodogaya Chemical Co., Ltd.) and 4 parts of aqueous solution of curing agent for polyurethane (B-20, a product of Hodogaya Chemical Co., Ltd.) were used in place of acetoacetylated polyvinyl alcohol and 5% aqueous solution of dimethylolurea.

COMPARISON EXAMPLE 6

A resin-coated heat-sensitive recording paper was prepared in the same manner as in Example 2 except that 12% aqueous solution of carboxyl-modified polyvinyl alcohol was used in place of acetoacetylated polyvinyl alcohol in the resin coating composition.

Images were printed on each of the above 20 kinds of resin-coated heat-sensitive recording papers with use of a heat-sensitive recording printer (Model PC-100A, a product of Texas Instruments Co., Ltd.). Sticking of the recording papers was observed and the results were given in Table 1 with the following evaluation.

Evaluation of sticking

○: No sticking

○: A little sticking but practically no problem

Δ: Considerable sticking and unsuited in quality

×: Marked sticking and unsuited to practical use

Further, images were formed by use of a heat gradient tester (Toyo Seiki Co., Ltd., condition: 120° C., 2 kg/cm$^2$, 10 seconds) and the initial color density of the images were measured by the Macbeth densitometer (Model RD-100R, a product of Macbeth Corp.) with use of an amber filter. The results were shown in Table 1. Table 1 also shows the color density after the paper was tested for the following resistances to plasticizer, oil and organic solvent by use of the Macbeth densitometer.

Resistance to plasticizer

A polyvinyl chloride wrap film (a product of Mitsui Toatsu Chemicals, Inc.) was wound threefold around a polypropylene pipe (40 mmϕ). A heat-sensitive recording paper having formed images was superposed on the film with images outward and thereon was wound a polyvinyl chloride wrap film fivefold. The color density was measured after 72 hours. The larger the value is, the better the resistance to plasticizer.

Resistance to oil

A few drops of soybean oil were applied to the images. The oil was wiped off with gauze after 24 hours and then the color density was measured. The larger the value is, the better the resistance to oil.

Resistance to organic solvent

A few drops of ethyl acetate were applied to the portion having no images and the color density was measured after 30 minutes. The smaller the value is, the better the resistance to organic solvent.

As apparent from the following Table 1, heat-sensitive recording materials of the invention showed no sticking when forming images and exhibited an excellent capability of retaining images for a long period of time.

TABLE 1

| | Sticking | Initial Color Density | Resistance to Plasticizer | Resistance to Oil | Resistance to Organic Solvent |
|---|---|---|---|---|---|
| Ex. 1 | ○ | 1.40 | 1.35 | 1.40 | 0.06 |
| Ex. 2 | ◎ | 1.40 | 1.34 | 1.40 | 0.06 |
| Ex. 3 | ◎ | 1.40 | 1.40 | 1.40 | 0.04 |
| Ex. 4 | ◎ | 1.40 | 1.37 | 1.40 | 0.06 |
| Ex. 5 | ◎ | 1.38 | 1.35 | 1.38 | 0.08 |
| Ex. 6 | ◎ | 1.40 | 1.34 | 1.40 | 0.04 |
| Ex. 7 | ◎ | 1.40 | 1.32 | 1.39 | 0.06 |
| Ex. 8 | ◎ | 1.40 | 1.31 | 1.40 | 0.06 |
| Ex. 9 | ◎ | 1.40 | 1.32 | 1.39 | 0.07 |
| Ex. 10 | ◎ | 1.40 | 1.32 | 1.40 | 0.08 |
| Ex. 11 | ◎ | 1.40 | 1.37 | 1.40 | 0.06 |
| Ex. 12 | ◎ | 1.40 | 1.37 | 1.40 | 0.05 |
| Ex. 13 | ◎ | 1.40 | 1.38 | 1.40 | 0.04 |
| Ex. 14 | ◎ | 1.40 | 1.38 | 1.40 | 0.04 |
| Com. Ex. 1 | X | 1.40 | 0.94 | 0.96 | 0.30 |
| Com. Ex. 2 | Δ | 1.40 | 0.96 | 0.92 | 0.43 |
| Com. Ex. 3 | Δ | 1.40 | 0.96 | 0.96 | 0.39 |
| Com. Ex. 4 | Δ | 1.39 | 0.45 | 0.52 | 0.91 |
| Com. Ex. 5 | Δ | 1.40 | 0.78 | 0.69 | 0.53 |
| Com. Ex. 6 | Δ | 1.40 | 0.96 | 0.94 | 0.30 |

We claim:

1. In a heat-sensitive recording material in which a resin layer is formed on a recording layer containing at least a color forming material and a color developing material which forms a color when reacted with the color forming material by contact, the improvement comprising said resin layer is essentially composed of an acetoacetylated polyvinyl alcohol, a copolymer comprising vinyl alcohol and acrylonitrile or a mixture of said acetoacetylated polyvinyl alcohol and said copolymer.

2. A heat-sensitive recording material as defined in claim 1 wherein the degree of acetoacetylation of the polyvinyl alcohol is 0.1 to 20 mole%.

3. A heat-sensitive recording material as defined in claim 1 wherein the acrylonitrile units content in the copolymer is 0.5 to 45 mole%.

4. A heat-sensitive recording material as defined in claim 1 wherein a curing agent is further added to the resin layer.

5. A heat-sensitive recording material as defined in claim 4 wherein the amount of the curing agent is 0.001 to 100 parts by weight per 100 parts by weight of the resin.

6. A heat-sensitive recording material as defined in claim 1, wherein said copolymer further comprises another copolymerizable monomer.

* * * * *